United States Patent [19]

Satoh

[11] Patent Number: 5,006,905

[45] Date of Patent: Apr. 9, 1991

[54] SEPARATING APPARATUS OF TRANSFER MATERIAL

[75] Inventor: Hisao Satoh, Hino, Japan

[73] Assignee: Konica Corporation, Tokyo, Japan

[21] Appl. No.: 413,847

[22] Filed: Sep. 28, 1989

[30] Foreign Application Priority Data

Oct. 7, 1988 [JP] Japan ..... 63-254304

[51] Int. Cl.[5] ..... G03G 15/00

[52] U.S. Cl. ..... 355/315; 271/312

[58] Field of Search ..... 271/307, 308, 312, 900; 355/315

[56] References Cited

U.S. PATENT DOCUMENTS

| | | | |
|---|---|---|---|
| 3,955,889 | 5/1976 | Ishiguro et al. | 355/315 |
| 4,252,310 | 2/1981 | Kono et al. | 355/315 X |
| 4,261,560 | 4/1981 | Yanagawa et al. | 271/308 |
| 4,748,473 | 5/1988 | Tsuruoka | 271/308 X |

FOREIGN PATENT DOCUMENTS

| | | | |
|---|---|---|---|
| 0162769 | 12/1981 | Japan | 355/315 |
| 0029281 | 2/1984 | Japan | 355/315 |
| 0094772 | 5/1984 | Japan | 355/315 |

OTHER PUBLICATIONS

Patent Abstracts of Japan; vol. 7, No. 206 (p. 222) [1351]; 9/10/83, JPA-58-100871; 6/15/83.

Patent Abstracts of Japan; vol. 8, No. 202 (p. 300) [1639]; 9/14/84, JPA-59-87474; 5/21/84.

Patent Abstracts of Japan; vol. 9, No. 292 (p. 406) [2015]; 11/19/85, JPA-60-130779; 7/12/85.

*Primary Examiner*—A. T. Grimley

*Assistant Examiner*—J. E. Barlow, Jr.

*Attorney, Agent, or Firm*—Jordan B. Bierman

[57] ABSTRACT

A separating device for separating a copy sheet from a photoreceptor of an electrophotographic copying machine after a toner image is transferred from the photoreceptor onto the copy sheet, comprising; a supporting plate, placed parallel to the photoreceptor, for supporting a pivotable claw, for separating the copy sheet from the photoreceptor in which the claw has a weight member opposite side from a tip of the claw so that the tip comes into contact with the surface of the photoreceptor by the weight of the weight member, and a wire, provided through the weight member of the claw, for pivoting the claw by tensioning and loosening the wire an end of the wire being fixed on the supporting plate.

3 Claims, 3 Drawing Sheets

SEPARATING APPARATUS OF TRANSFER MATERIAL

BACKGROUND OF THE INVENTION

The present invention relates to an improvement in the function of a separating claw provided in a separating module of an image producing apparatus for the separation of a transfer material.

The transfer material fed to a photoreceptor surface is attracted to the photoreceptor surface which has a toner image on it by the function of a transfer electrode to transfer the toner image from the photoreceptor surface onto the transfer material. The transfer material is separated from the photoreceptor surface discharged by the charge of a separating electrode and is then sent to a fixing station.

The discharge of the separating electrode mentioned above, however, can not insure perfect separation with every kind of copy paper and in every atmospheric condition of temperature and humidity, and incomplete separation sometimes occured.

Accordingly, a mechanical separator is usually provided at the processing site below the position of the separating electrode to reinforce the separation of a transfer material.

For this mechanical separator, a plurality of claws are provided at the separating site which touch the photoreceptor surface softly by the rotating moment of their weight or with the aid of spring attached to the one end of the claw.

In cases like this, the residual toner on the photoreceptor surface sometimes drops down onto the transfer material surface while being scraped off with the claws; and it causes the damage of the toner image quality.

The claw itself wears easily due to constant contact with the photoreceptor surface and is also apt to scratch the photoreceptor surface when the claw is smudged and coated with some foreign material such as toner, paper dust, and etc.

To prevent these problems, a separating claw having a releasing mechanism driven by a solenoid coupled with a lever member having a rotating axis in order to avoid constant contact with the photoreceptor surface has been proposed.

By reducing contacting time of the claw with the photoreceptor surface only to when a leading edge of the transfer material passes by the separating site, the damage to toner image quality caused by the dropped toner, the damage to the photoreceptor surface, and the wear of the claw caused by the constant contact with the photoreceptor surface can be solved. Even with this idea, however, when the coupling part for the rotation of the claw or sliding part of the claw will be smudged with spewed toner, more load in the rotation of the claw is needed. Solving this problem forcedly, increasing the capacity of the solenoid, requires more space to install the solenoid.

An object of the invention is to propose an improved separating mechanism where the claw can be operated with a solenoid of small capacity which doesn't require much space.

SUMMARY OF THE INVENTION

The aforesaid object may be achieved by a separating means which consists of a claw having a pivot at its center to rotate, a balance weight at the opposite end to the claw tip, and a releasable wire being connected with the balance weight of the claw, wherein by loosening the wire, the claw contacts with the photoreceptor surface to separate the transferred material which has toner image on it and by stretching the wire, the claw can be moved from the contact with the photoreceptor surface.

DETAILED DESCRIPTION OF THE INVENTION

Figure 1:
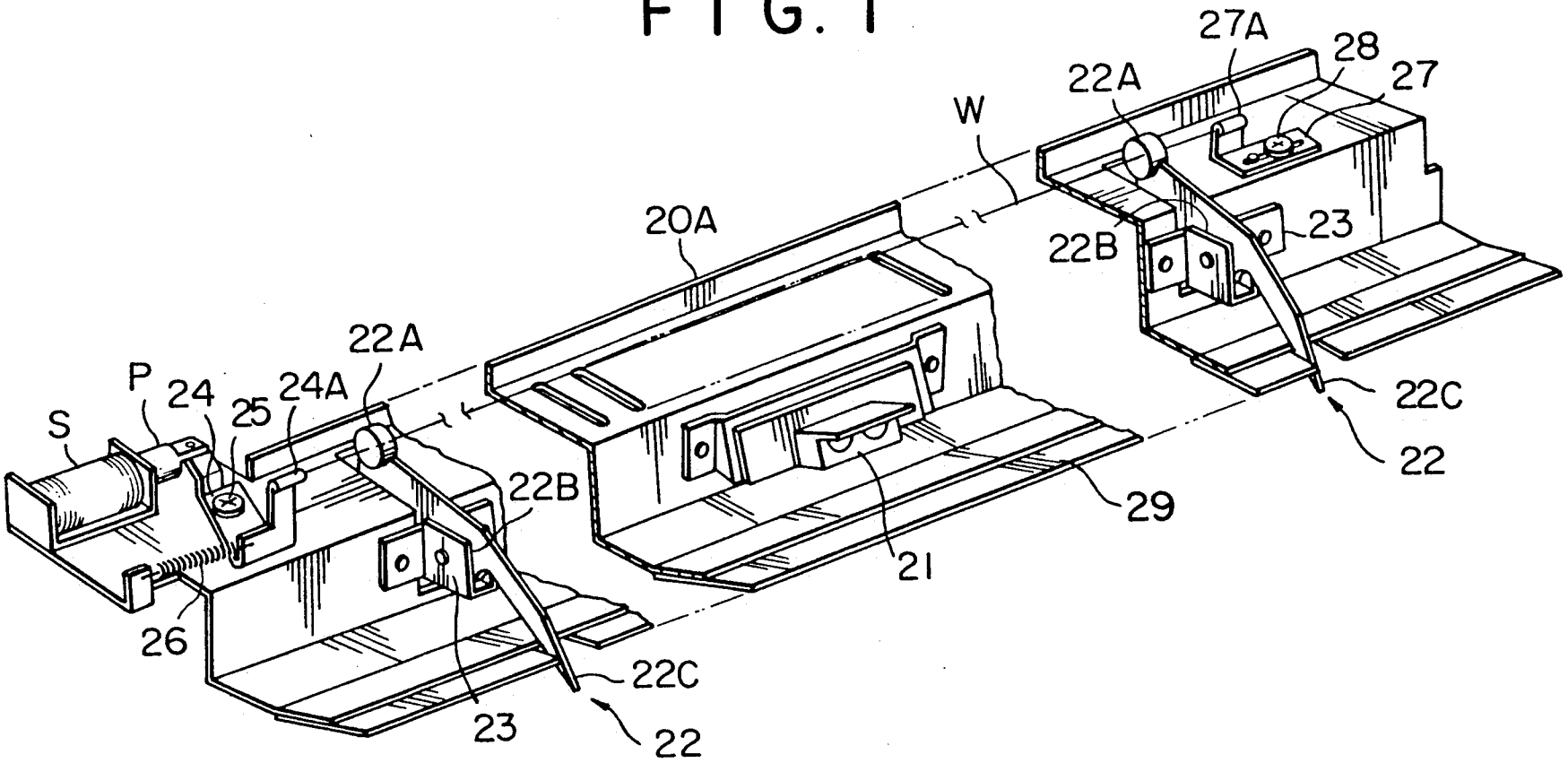
FIG. 1 and FIG. 2 are perspective side views of the separating device for tranfer material constructed in accordance with the present invention.
Figure 3:
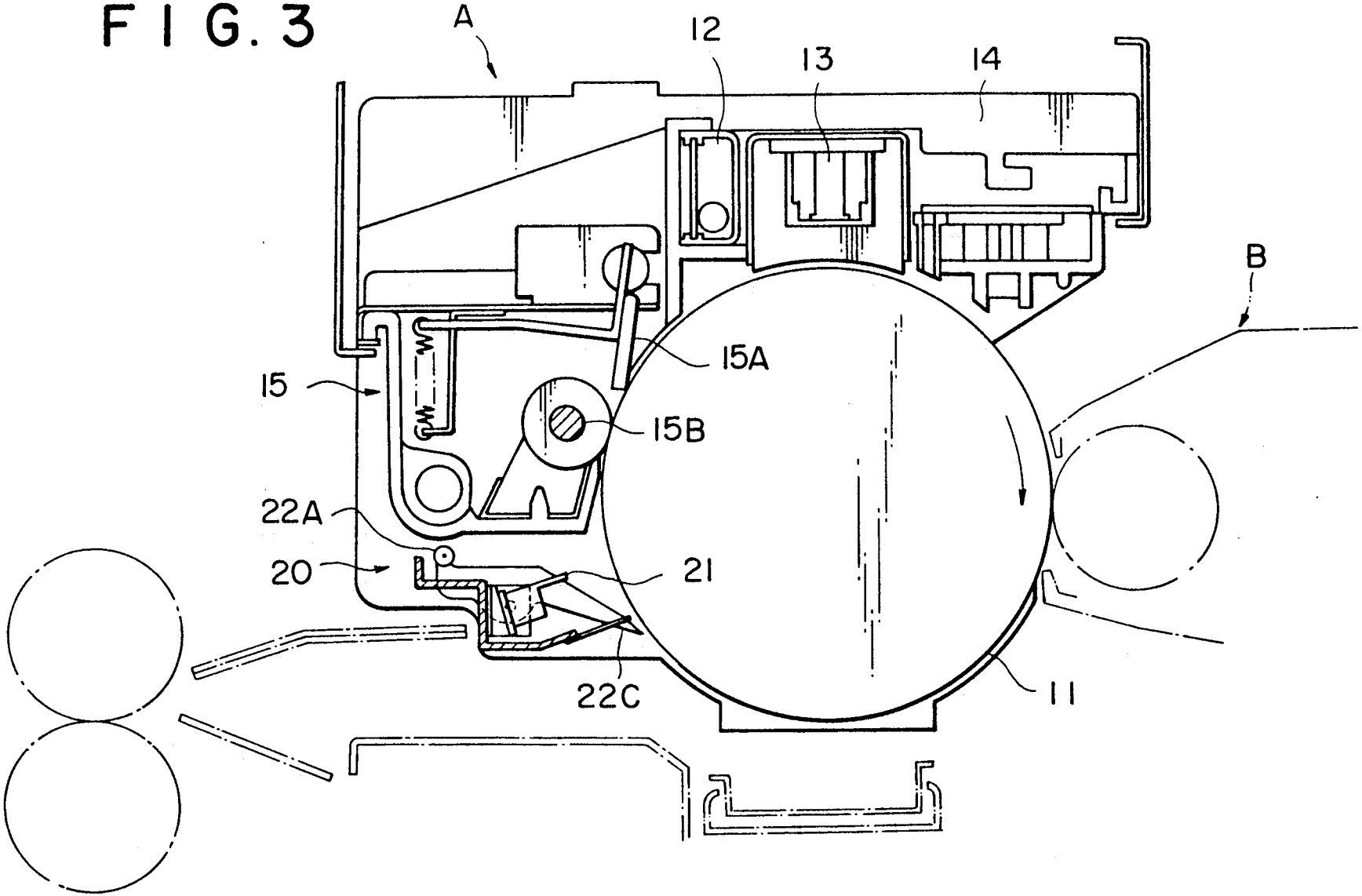
FIG. 3 is a view of main structure of image producing apparatus which has the aforesaid mechanism.

FIG. 1 and FIG. 3 show an example of the embodiment of the invention. FIG. 3 is a view of a portion of an image producing apparatus in which aforesaid mechanical device is incorporated. The separating device is incorporated in the photoreceptor module A which is a part of image producing mechanism and is constructed so as to be attached to or detached from the image producing apparatus.

11 is a photoreceptor drum which rotates in the arrowed direction. 12 is an exposure device which discharges the charge remaining on the photoreceptor surface prior to the charging at the start of the process, 13 is the charger. 14 is a discharging device which eliminates the charge present outside of image area. 15 is a cleaning device wherein cleaning blade 15A which contacts the photoreceptor surface and toner guide roller 15B which is rotated as a follower to the rotation of the photoreceptor are incorporated. 20 is a separating device for transfer material which is provided in the lower part of the cleaning device so as to face the photoreceptor surface.

Figure 2:
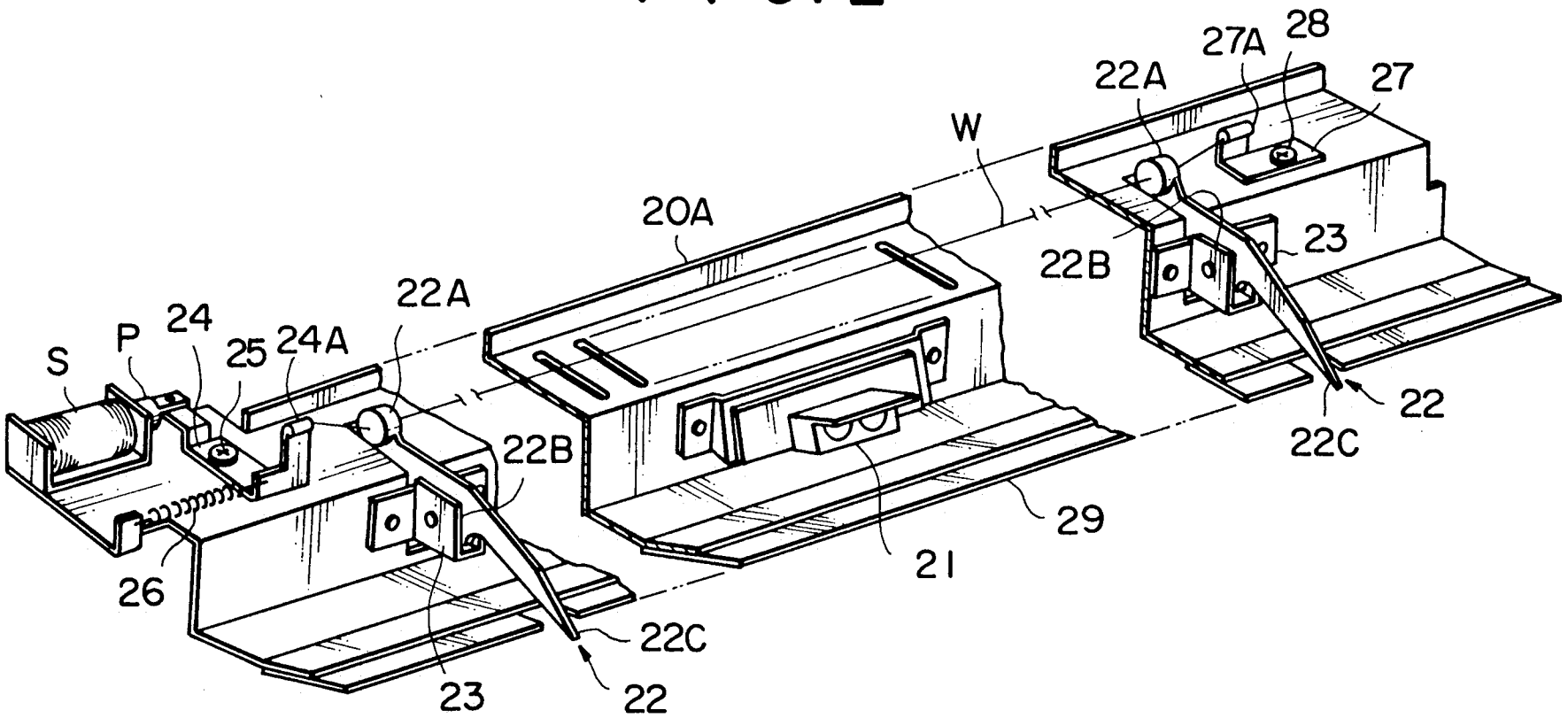

FIG. 1 and FIG. 2 show the mechanical construction of the separating device 20 wherein each part is assembled on a cover member 20A made of a plate like material to structure a module.

21 is a photo-electric sensor detecting toner density of a standard sample image made on the photoreceptor surface by a reflection density measuring method. The toner fed to the developing device B is controlled by the detected data gained in the photo-electric sensor.

22 is a pair of separating claws mounted at the right side and left side positions of the supporting plate 29 of a cover member 20A to mechanically separate a transfer material attached to the photoreceptor surface. Each of the claws consists of three parts, that is, claw tip 22C, pivot 22B for rotation at its central part and balance weight 22A at one end of the claw. Aforesaid pivot 22B of the separating claw 22 is supported by supporting member 23 fixed at the cover member 20A to rotate freely counterclockwise by the balance weight 22A provided at the end of the claw.

A rotatable lever 24 is fixed to the left side of the cover member 20A with a screw 25 which has a step-shaped head in order to rotate on its center and is forced to rotate clockwise by a spring 26. And, a bent portion 24A of the rotatable lever 24 tightly holds one end of a wire, which is explained later, by clamping the wire inserted through a hole provided at the top of the bent portion 24A.

S is a plunger type solenoid activated by electricity from the main frame. The top of the plunger P is connected to the other end of the rotatable lever 24 to make the lever rotate freely on the pivot 25.

27 is a wire fixing part set up at the right side of the cover member 20A and is fixed to it with a screw 28 after adjusting its position moving the hole of the part along with a pin provided on the cover member.

The wire fixing part 27 also has a bent portion 27A to which the another end of the wire is clamped to hold the wire tightly after insertion through a hole as previously explained.

W is aforesaid wire for which thin metal wire having good flexibility or thin plastic resin wire having no deforming characteristic for elongating or shrinking to its length can be used.

Aforesaid wire is inserted through a small hole provided at the weight 22A fixed to the one end of the claw 22; and one end of wire is fixed to the top of the bent protion 24A of the rotatable lever 24 and the another end of the wire is fixed to the top of the bent portion 27A of the fixing part 27.

The placement of the fixing part 27 on the cover member 20A is adjusted so as to let the wire stretch straight when the solenoid S is cut off the electricity and the rotatable lever 24 is rotated clockwise to the far end by the spring 26, so that each claw tip 22C of the separating claw 22 is held a little bit apart over the photoreceptor surface as is shown in FIG. 3.

No matter whether the image producing apparatus is on or off, if the transfer material is not at the separating position, solenoid S is kept in off state, accordingly the claw keeps the state shown in FIG. 3.

With the start of the paper feeding roller, transfer material is fed to the surface of the photoreceptor and when the leading edge of the transfer material passes the transfer electrode 16 and separating electrode 17, solenoid S is activated to pull and rotate the rotatable lever 24 counterclockwise against the force of spring 26 as is shown in FIG. 2, and thus the stretched wire W is loosened by the action of the solenoid S. In this manner, the separating claw 22 is released from the restraint by the wire and the claw tip 22A of the separating claw 22 contacts with the surface of the photoreceptor.

Power switching of the solenoid S is performed by a timer which starts in accordance with the start of the feeding roller or by a signal from a sensor which detects the leading edge of a transfer material coming to the separating site.

As soon as the transfer material passes the position of the separating claw, solenoid S is switched off and returned back to the position shown in FIG. 1.

The present invention using wire, instead of ordinary releasing mechanism which uses sliding member or rotating member, can reduce load to the solenoid, solenoid capacity and space needed to be fixed.

According to this invention, the contacting or releasing of the claw to the photoreceptor surface can be attained very effectively with a very simple device. Resultingly, a long life separating device for transfer material, which can avoid the needless sliding by the claw on the photoreceptor surface and the toner drop resulted from the sliding of the claw, has been proposed.

What is claimed is:

1. A separating device for separating a transfer material from a surface of a photoreceptor of an electrophotographic copying apparatus after a toner image is transferred from said photoreceptor onto said transfer material, said separating device comprising;

a supporting member, placed parallel to said photoreceptor, for supporting a pivotable claw member thereon, said claw member, adapted for separation of said transfer material from said photoreceptor, having a weight member on a first end and a tip on a second end opposite said first end whereby said tip comes into contact with said surface of said photoreceptor by the weight of said weight member, and a wire member, provided through said weight member for pivoting said claw member so that said tip is removed from contact with said surface by tensioning said wire member.

2. The apparatus claimed in claim 1, further comprising a wire tension means for tightening said wire member by a spring member and loosening said wire member by a solenoid.

3. The apparatus claimed in claim 2, wherein an end of said wire member is fixed on said supporting plate member.

* * * * *